US005136949A

United States Patent [19]

Grosch

[11] Patent Number: 5,136,949

[45] Date of Patent: Aug. 11, 1992

[54] MINE SYSTEM

[75] Inventor: Hermann Grosch, Birkenweg, Fed. Rep. of Germany

[73] Assignee: Rheinmetall GmbH, Dusseldorf, Fed. Rep. of Germany

[21] Appl. No.: 751,984

[22] Filed: Aug. 28, 1991

[30] Foreign Application Priority Data

Aug. 28, 1990 [DE] Fed. Rep. of Germany ..... 4027150

[51] Int. Cl.[5] ..... F42C 15/42

[52] U.S. Cl. ..... 102/215; 102/221; 102/401

[58] Field of Search ..... 102/200, 215, 221, 401, 102/424, 427

[56] References Cited

U.S. PATENT DOCUMENTS

| | | | |
|---|---|---|---|
| 3,888,181 | 6/1975 | Kups | 102/221 |
| 4,254,475 | 3/1981 | Cooney et al. | 102/215 |
| 4,712,479 | 12/1987 | Babel | 102/427 |
| 4,712,480 | 12/1987 | Lindstadt et al. | 102/427 |
| 4,884,506 | 12/1989 | Guerreri | 102/200 |
| 4,934,269 | 6/1990 | Powell | 102/221 |

FOREIGN PATENT DOCUMENTS

| | | |
|---|---|---|
| 0149778 | 7/1985 | European Pat. Off. . |
| 3523857 | 1/1987 | Fed. Rep. of Germany . |
| 3538786 | 5/1987 | Fed. Rep. of Germany . |
| 354289 | 6/1987 | Fed. Rep. of Germany . |
| 2090017 | 6/1982 | United Kingdom . |

*Primary Examiner*—Charles T. Jordan

*Attorney, Agent, or Firm*—Spencer, Frank & Schneider

[57] ABSTRACT

A system for remotely programming a mine includes a programming device comprising a computer having a data memory storing functions required to control the mine once laid, a code word memory and a random number generator. Stored data is displayed on an output device. A random number generator generates random numbers corresponding to respective addresses in data memory under which selected displayed functions are stored. The random numbers are stored as code words, together with corresponding data memory addresses, in the code word memory. A transmitter connected to the computer transmits the contents of the code word memory. A programmable electronic unit in the mine includes a receiver and a second computer. The second computer has a second code word memory for storing the transmitted code word memory, and a second data memory corresponding to the data memory of the programming device storing identical data. The second computer correlates a subsequently received code word with a code word previously stored in the second code word memory so that the function in the second data memory stored under the address corresponding to the subsequently received code word can be carried out.

8 Claims, 2 Drawing Sheets

MINE SYSTEM

BACKGROUND OF THE INVENTION

The present invention relates to a system and method for programming a mine by means of a programming device which includes a microcomputer connected to a transmitter for contactless transmission of signals for reception by a mine equipped with a receiver tuned to the transmitter for receiving the signals and connected to a microcomputer-like electronic unit in the mine.

Such mine systems and methods are known which program mines before they are laid, that is, for the normally contactless transmission of data to control desired actions within the mine after it is laid, with the data being stored in a type of data memory within the mine.

For example, German Offenlegungsschrift [laid-open patent application] No. 3,523,857 discloses a mine system of the above type in which data can be transmitted without contact from a programming device to one or a group of mines. The data are transmitted in the form of infrared signals through the intermediary of one or a plurality of input devices to an individual mine or a group of mines before they are laid and are stored in a data memory in the mine or mines. This German patent application, however, does not discuss remotely programming the mines after they are laid.

German Offenlegungsschrift No. 3,545,289 discloses a remotely programmable mine which accommodates in its mine housing a receiving unit as well as a programming unit. The mine itself includes two memories within an electronic unit, with a spoken word or sentence being stored in digitized form in the first memory when the mine is laid. A word or sentence transmitted to the mine or mines after laying is received in the mine by a receiver, is digitized and stored in a second memory and then compared with the word stored in the first memory. If there is coincidence between the words, the mine is to be secured again. The drawback of this device is the use of acoustic methods for remotely influencing the mines. It is generally known that due to the structure and operation of the human speech forming apparatus, a speaker is hardly able to pronounce the same word (or the same sentence) completely identically several times in succession, even within a short time interval, that is identical in pronunciation and inflection, etc. Thus, there inevitably exist differences between the spoken programmed word (or sentence) and the word (or sentence) transmitted later for remote actuation, particularly if this word is intended for a large number of mines and is possibly to be transmitted to the mine(s) through the intermediary of further transmitting means (e.g. a megaphone).

For a mine system according to Offenlegungsschrift No. 3,545,289 to operate in the desired manner, the accuracy of the compilation of the characteristics of the programming word must be reduced to such an extent that it considers all possible variations in the word with respect to pronunciation, inflection, etc., during the subsequent remote transmission. If, perhaps, other persons than the speaker of the programming word are to be authorized to effect a later remote actuation, the accuracy in the compilation of the word characteristics must be further reduced.

Additionally, the use of words and sentences that generally will be taken from terms originating in the programming speaker's environment, harbors the danger that these words or sentences may inadvertently be generated in another connection and possibly be detectable for the mine(s). The programmable mine system intended for later remote programming as disclosed in Offenlegungsschrift No. 3,545,289 is thus unable to meet the modern requirements for such mine systems with respect to accuracy, reproducibility and security against deception for reliable, remote programming only by friendly forces.

SUMMARY OF THE INVENTION

It is therefore an object of the present invention to provide a novel programmable mine system which avoids the above-described drawback of programmable mine systems of this type and with which it is possible to reproducibly and remotely program a mine in a secure manner to prevent deception and without the danger of inadvertent actuation.

The above and other objects are accomplished according to the invention by the provision of a system for remotely programming a mine, comprising: a programming device remote from the mine, including: a computer having a data memory storing data representing all functions required to control the mine once the mine is laid, a code word memory and a random number generator for generating random numbers upon request; output means connected to the computer for displaying the data contained in the data memory; input means connected to the computer for causing the data stored in the data memory to be displayed by the output means, for requesting the random number generator to generate random numbers corresponding to respective addresses in the data memory under which selected functions displayed by the output means are stored, and for causing the storage of the generated random numbers as code words, together with corresponding data memory addresses, in the code word memory; and transmitter means connected to the computer for providing contactless transmission of the contents of the code word memory; and a programmable electronic unit for placement in the mine, including: receiving means tuned to the transmitter means of the programming device for receiving the contactless transmission of the transmitter means; and a second computer connected to the receiving means and having a second code word memory corresponding to the code word memory of the programming device for storing the contents of the code word memory transmitted by the transmitter means, a second data memory corresponding to the data memory of the programming device storing data identical to the data stored in the data memory of the programming device, and means for correlating a code word received subsequently by the receiving means with a code word previously stored in the second code word memory for identifying a function in the second data memory stored under the address corresponding to the subsequently received code word.

The particular advantage of the mine programming system according to the invention is that the use of a random number generator in the programming device for the generation of code words makes the probability of the coincidence of code words with terms from the operator's environment unlikely. Thus, the danger is very low that such a code word, once formed, would inadvertently be generated and transmitted by other machines, even enemy machines during a later passage.

Moreover, the complete generation of code words in the programming device is able to take place exclusively in the interior of the machine, without the respective code words being displayed, so that even the programming operator has no knowledge whatsoever of the code word or code words that were generated. Thus, the generation and later transmission of code words is secure against deception.

Another advantage of the mine programming system according to the invention is the use of identical components, such as code word memories and data memories, in the programming device as well as in the mines, with additionally the data memory of each mine receiving the same fixedly programmed information at the same addresses as the programming device. Thus, it becomes possible to assemble a simple, standardized configuration, possibly in modular form, which makes it possible to safely link together the mines as well as the programming device.

Since, according to the invention, all functions required for controlling the mine, once it has been laid, are stored in the form of data, it is possible to address not only one information (that is, a single action in the mine) by means of a code word, but, if necessary, a code word generated in the random number generator may also be associated with a precisely defined linkage of individual data, while precisely specifying their hierarchy in the program run.

According to another aspect of the invention there is provided a method of programming a mine by a remote programming device which includes a computer having a data memory for storing data corresponding to all functions required to control the mine once the mine is laid, comprising: displaying, on a display connected to the computer, a listing of all data stored in the data memory by actuation of a keyboard input connected to the computer; selecting and marking at least one of the displayed data by way of the keyboard input; generating a respectively different code word comprised of a random number for each one of the marked data; storing the code words together with data memory addresses belonging to the individual marked data in a code word memory; and transmitting, by a contactless transmission initiated by way of the keyboard input, the contents of the code word memory of the programming device for reception by the mine.

The method of programming mines according to the present invention with the aid of a programming device allows simple operation and manipulation even for relatively unskilled users.

The mine programming system according to the invention will now be described and explained in greater detail with reference to the accompanying drawings.

DETAILED DESCRIPTION OF THE PREFERRED EMBODIMENT

Figure 1:
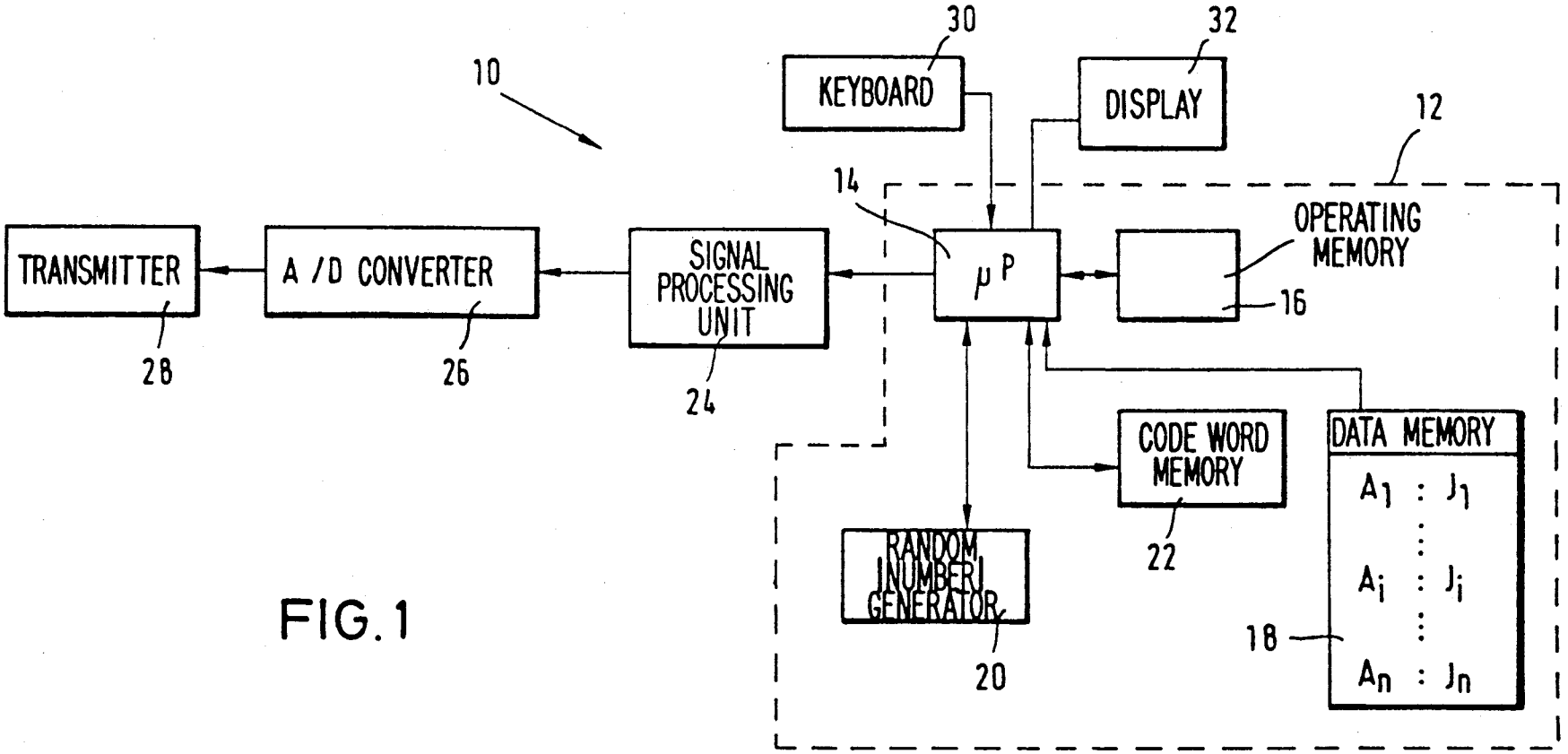
FIG. 1 is a block circuit diagram of a programming device according to the invention.

Referring to FIG. 1, there is shown a programming or operator device 10 which includes a microcomputer 12. Microcomputer 12 comprises a central processing unit (uP) 14 which serves as a central controller, an operating memory 16, a data memory 18 which is configured as a read-only memory (ROM), a random number generator 20 and a code word memory 22. A keyboard 30 is provided for the manual input and actuation of program operations within microcomputer 12. An output unit, visible to the operator, in the form of a display 32, preferably an LCD display comprising only a few lines, is built into programming device 10.

Data memory 18 contains all of the data required for controlling the mine in the form of functions $J_1$ to $J_n$ and possibly linkages of individual functions as respectively independent data $J_i$. Each function or linkage of functions $J1_1$ to $J_n$ has a fixed address $A_1$ to $A_n$ in memory 18.

Programming device 10 has a further output in the form of a contactless transmission by way of a transmitter 28, preferably a high frequency (HF) transmitter, coupled to a microcomputer 14 through an analog-to-digital (A/D) converter 26 and a signal processing unit 24.

Figure 2:
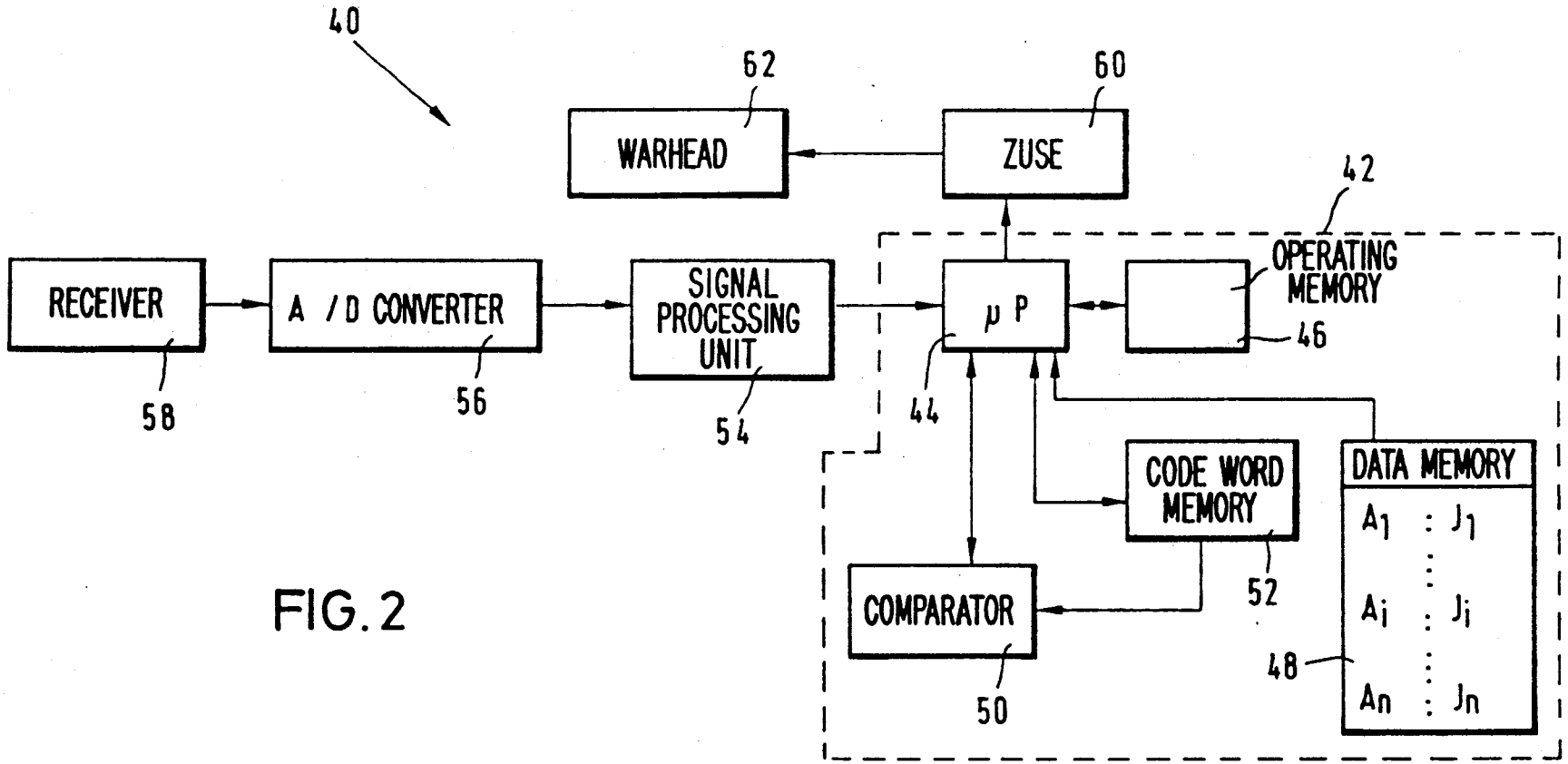
FIG. 2 is a block circuit diagram of a programmable electronic unit in a mine according to the invention.

Referring to FIG. 2, there is shown a programmable electronic unit for placement in a mine 40 and which, like programming device 10, includes a microcomputer 42. Microcomputer 42 includes a central processing unit (uP) 44, an operating memory 46 as well as a data memory 48 which, like data memory 18 in programming device 10, is a read-only memory and contains the same data $J_1$ to $J_n$ at the same addresses $A_l$ to $A_n$. Microprocessor 42 of mine 40 further includes a comparator 50 and a code word memory 52 which has a configuration corresponding to that of code word memory 22 of programming device 10. Signals sent to mine 40 are received by a receiver 58, preferably an HF receiver, and sent to an analog/digital (A/D) converter 56, which corresponds to A/D converter 26 of programing device 10, and then to a signal processing unit 54 from where they go to microcomputer 42.

Microcomputer 42 has an output connected to a detonation and safety unit (ZUSE) 60 which is in turn connected for triggering a warhead 62 in a known manner.

The sensors, evaluation circuits and energy supplies customarily employed in a mine such as this, as well as in the programmable device 10, are known per se and thus are not shown here for the sake of simplicity.

The operational sequences within the mine programming system according to the present invention take place as follows:

In order to program one or a group of mines, an operator calls up, by way of keyboard 30 of the operational programming device 10, the contents of data memory 18, that is, all data $J_1$ to $J_n$, and displays them on output display 32 in the form of a list or the like. Then the operator selects from the list of displayed data, all those data which correspond to actions that are to be remotely actuated after the mine 40 has been laid. The selected data $J_i$, or the selected group of data, is marked by the operator by way of an input to keyboard 30. A renewed keyboard input now initiates a coding process in which random number generator 20 generates certain code word for each address $A_i$ of the selected data $J_i$.

Once this process is completed, the addresses and their associated code words are stored in code word memory 22. A display of the code words on display 32 may possibly be omitted.

To actually program mine 40, an input to the keyboard causes the contents of code word memory 22 in programming device 10 to be transferred by means of central processing unit 14 to signal processing unit 24 and then this information is transmitted through the intermediary of analog/digital converter 26 to transmitter 28. Each mine 40 that is to be programmed by means of the code words generated in programming device 10 has in the meantime been switched to a ready to receive mode and thus receives the signal transmitted by transmitter 28 in its receiver 58 and transmits it via analog/digital converter 56 to signal processing unit 54, and by way of central processing unit 44, stores the received signals in code word memory 52, after which the mine is ready to be laid.

If after these mines 40 have been laid, a desired action is to be initiated in the mines, for example, making them secure again or resetting a detonation delay time, the operator is able to display on display 32 of programming device 10 the selected data stored in code word memory 22 by using keyboard 30 as an input device. For safety reasons, the code words associated with the individual selected data should not be displayed. After again selecting and marking the action desired in mines 40 by the keyboard input, the code word or words belonging to the selected function (action) is taken from code word memory 22 and sent to transmitter 28 from where it is transmitted. Each mine 40, which is ready to receive, picks up the signal in its receiver 58 and sends it in the manner already described to central processor 44. The received code word is now transferred by central processor 44 to comparator 50 which compares it with all code words stored in code word memory 52. If the transmitted code word should coincide with one of the code words in the code word memory, the address $A_i$ belonging to the code word for the respective information $J_i$ is read out of code word memory 52. By way of this address $A_i$, the corresponding action present as data $J_i$ is read out of data memory 48 and is transmitted via central processing unit 44 to the detonating and safety device 60 which, in turn, is able to directly address warhead 62.

Microcomputers 12 and 42 can be based on an Intel 8080 microprocessor, Motorola 6502 or similar system. Signal processing unit 24 in programming device 10 and signal processing unit 54 in mine 40 are interfaces between the $\mu$P and the A/D converter in each case. The frequency range of the HF transmitter 28 should be 100 kHz or more.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A system for remotely programming a mine, comprising:

a programming device remote from the mine, including:

a computer having a data memory storing data representing all functions required to control the mine once the mine is laid, a code word memory and a random number generator for generating random numbers upon request;

output means connected to said computer for displaying the data contained in said data memory;

input means connected to said computer for causing the data stored in said data memory to be displayed by said output means, for requesting said random number generator to generate random numbers corresponding to respective addresses in said data memory under which selected functions displayed by said output means are stored, and for causing the storage of the generated random numbers as code words, together with corresponding data memory addresses, in said code word memory; and transmitter means connected to said computer for providing contactless transmission of the contents of said code word memory; and a programmable electronic unit for placement in the mine, including:

receiving means tuned to the transmitter means of said programming device for receiving the contactless transmission of said transmitter means; and a second computer connected to said receiving means and having a second code word memory corresponding to the code word memory of said programming device for storing the contents of said code word memory transmitted by said transmitter means, a second data memory corresponding to the data memory of said programming device storing data identical to the data stored in the data memory of said programming device, and means for correlating a code word received subsequently by said receiving means with a code word previously stored in said second code word memory for identifying a function in said second data memory stored under the address corresponding to the subsequently received code word.

2. A system as defined in claim 1, wherein said correlating means in said second computer means includes a comparator coupled to said second code word memory for comparing the subsequently received code word with each of the code words previously stored in said second code word memory to identify the address of the function corresponding to the subsequently received code word.

3. A system as defined in claim 1, wherein the computer in said programming device is responsive to said input means for causing a code word stored in said code word memory, corresponding to an address of a selected function stored in said data memory, to be transmitted by said transmitter means.

4. A system as defined in claim 1, wherein said transmitter means and said receiving means transmit and receive, respectively, high frequency signals.

5. A system as defined in claim 1, wherein said data memory and said second data memory are each read-only memories.

6. A method of programming a mine by a remote programming device which includes a computer having a data memory for storing data corresponding to all functions required to control the mine once the mine is laid, comprising:

displaying, on a display connected to the computer, a listing of all data stored in the data memory by actuation of a keyboard input connected to the computer;

selecting and marking at least one of the displayed data by way of the keyboard input;

generating a respectively different code word comprised of a random number for each one of the marked data;

storing the code words together with data memory addresses belonging to the individual marked data in a code word memory; and transmitting, by a contactless transmission initiated by way of the keyboard input, the contents of the code word memory of the programming device for reception by the mine.

7. The method as defined in claim 6, wherein the mine has a second computer including a code word memory and a second data memory storing the same data as the data memory of the programming device, said method further comprising:

receiving, by way of a receiver in the mine, the contactless transmission from the programming device and storing the code words together with the corresponding addresses in the second code word memory.

8. The method as defined in claim 7, and further comprising:

transmitting a code word corresponding to a selected function stored in the second data memory to control the mine;

receiving the code word by the receiver in the mine;

comparing the received code word with each code word previously stored in the second code word memory to identify the address in the second data memory corresponding to the selected function so that the selected function can be carried out.

* * * * *